United States Patent [19]

Montgomery

[11] Patent Number: 4,723,821

[45] Date of Patent: Feb. 9, 1988

[54] DRAWING DISPLAY BOARD ATTACHMENT FOR TOOL BOXES

[75] Inventor: Michael G. Montgomery, Anoka, Minn.

[73] Assignee: Chest Mate, Inc., St. Louis Park, Minn.

[21] Appl. No.: 923,563

[22] Filed: Oct. 27, 1986

[51] Int. Cl.[4] ..... A47B 27/00; A47B 63/04

[52] U.S. Cl. ..... 312/231; 312/DIG. 33

[58] Field of Search ..... 312/231, DIG. 33, 243, 312/269, 270, 114; 108/6

[56] References Cited

U.S. PATENT DOCUMENTS

| | | | |
|---|---|---|---|
| 393,934 | 12/1888 | Talbott | 312/231 |
| 654,841 | 7/1900 | MacDonald | 312/231 |
| 947,967 | 2/1910 | Gardner | 312/270 |
| 2,356,924 | 8/1944 | Froelich | 108/6 |
| 2,733,113 | 1/1956 | Humbargar | 312/DIG. 33 |
| 3,405,985 | 10/1968 | Higer | 312/114 |
| 3,669,227 | 6/1972 | Alford | 312/231 |
| 3,701,576 | 10/1972 | Moen | 312/231 |
| 4,150,861 | 4/1979 | Dufrancatel | 312/DIG. 33 |
| 4,255,001 | 3/1981 | Frishman | 312/114 |
| 4,456,286 | 6/1984 | Jamar | 312/231 |

*Primary Examiner*—Victor N. Sakran

*Attorney, Agent, or Firm*—Herman H. Bains

[57] ABSTRACT

A display board attachment used by machinists in machine shops includes a display board pivotally mounted by posts on a tool box. The display board is pivoted between an upwardly inclined operative position and a horizontal collapsed position. The tool box cover may be readily opened and closed when the display board is in the collapsed position. When the display board is in the operative position, it will support and display a blueprint or shop drawing for ready reference by a machinist.

2 Claims, 4 Drawing Figures

DRAWING DISPLAY BOARD ATTACHMENT FOR TOOL BOXES

This invention relates to a display board attachment for tool boxes.

BACKGROUND OF THE INVENTION

In commercial machine shops and job shops, skilled machinists typically use blueprints or shop drawings in performing finishing, sub-assembly, and inspection type jobs. Skilled machinists usually own their own tools, and these tools are usually stored in the machinists tool box. Blueprints and shop drawings are usually placed in any convenient location by machinists, and these prints or drawings must be referred to constantly by the machinist. This kind of handling results in the drawings or prints becoming soiled and smudged with grease and oil so that the prints are often difficult to read. There are presently no commercial holders or display devices for holding and displaying shop drawings for use by machinists in machine shops.

SUMMARY OF THE INVENTION

An object of this invention is to provide a novel display board attachment for tool boxes which serves to effectively support and display a blueprint or shop drawing for use by machinists.

Another object of this invention is to provide a novel display board attachment, of simple and inexpensive construction, which displays shop drawings or prints for ready observation by machinists, and protects the prints against damage from grease and oil.

A further object of this invention is to provide a display board attachment for shop drawings and the like having a transparent protective sheet upon which modifications to the drawing parts or changes in dimensions may be written by the user.

These and other objects of the invention are more fully defined in the following specification.

FIGURES OF THE DRAWING

DESCRIPTION OF THE PREFERRED EMBODIMENT

Figure 1:
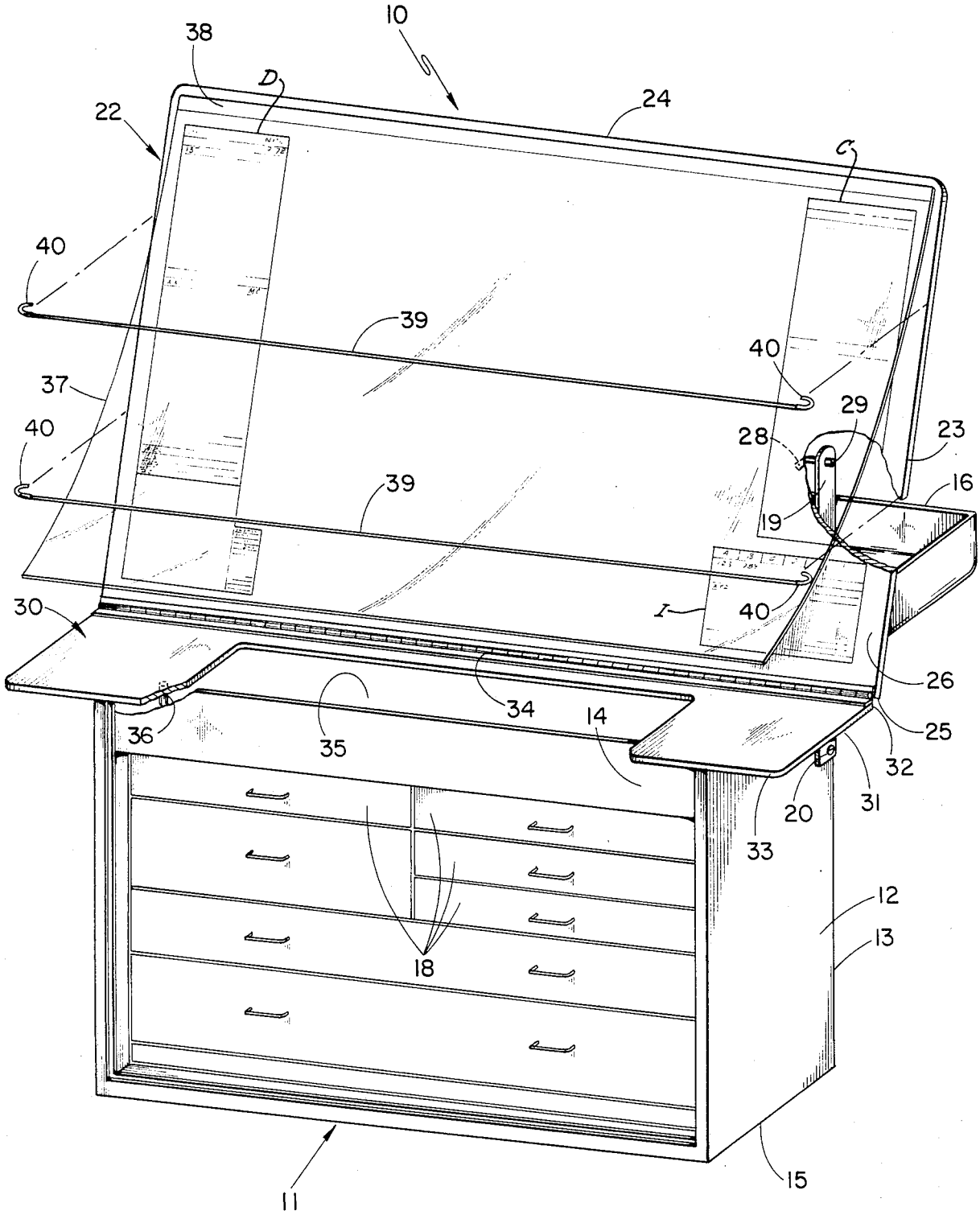
FIG. 1 is a perspective view of the novel display board attachment mounted on a tool box and illustrated in an upright operative position.

Referring now to the drawings and more specifically to FIG. 1, it will be seen that one embodiment of the novel display board attachment, designated generally by the reference numeral 10, is thereshown. The display board attachment 10 is mounted on a conventional tool box 11, which includes side walls 12, rear wall 13, front wall 14, bottom wall 15, and cover 16 hinged to the rear wall. The tool box may be provided with a plurality of trays 18 which contains the various tools used in a conventional machine shop or job shop where the machinists perform various finishing, subassembly, assembly, and inspection type jobs. In performing these jobs, machinists are required to work with blueprints or shop drawings, and these drawings are sometimes fairly large, and the machinist usually has no convenient space in which to place the drawings so that he can make ready reference to them.

The display board attachment 10 is detachably mounted on the conventional tool box 11 and includes a pair of elongate substantially straight mounting posts 19 which are secured to the side walls 12 of the tool box with suitable bolts 20. The posts 19 may be formed of a suitable metal and each post 19 has an opening 21 in the upper end portion thereof.

Figure 2:
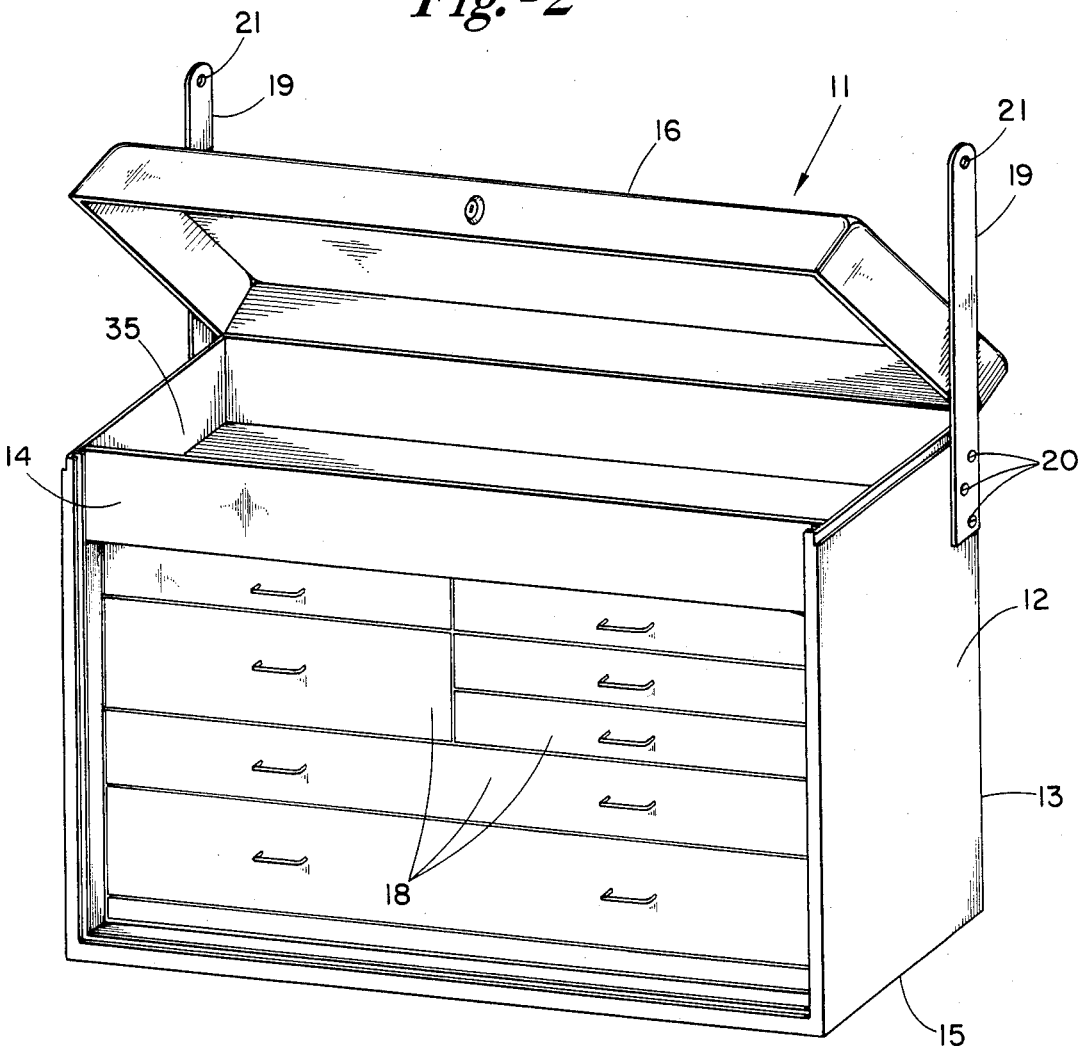
FIG. 2 is a front perspective view of the tool box with the display board detached therefrom.

The display board attachment 10 also includes a generally rectangular-shaped substantially flat display board 22 having side edges 23, an upper edge 24, and a lower edge 25. The display board 22 has a substantially flat front surface 26 and a substantially flat rear surface 27. The display board 22 is formed of a substantially rigid material, preferably a rigid plastic material, although the display board may be formed of wood or other rigid materials. The rear surface 27 of the display board is provided with a pair of rearwardly projecting ears 28. It will be noted that the ears are located approximately mid-way between the upper and lower edges of the display board. Each ear has a pin 29 projecting outwardly therefrom and the pins are adapted to be positioned in the openings in the upper end portions of the posts 19. With this arrangement, the display board 22 may be readily shifted between an upright operative position, as illustrated in FIG. 2, and an inoperative collapsed position, as illustrated in FIG. 3.

The display board 22 has a panel 30 hingedly connected to the lower edge portion thereof, and the panel 30 is of generally rectangular-shaped configuration and includes opposed side edges 31, an upper edge 32, and a lower edge 33. In the embodiment shown, a hinge 34 hingedly interconnects the lower edge portion of the display board with the upper edge portion of the panel 30 to permit pivoting movement of the panel about a transverse axis. It will also be noted that the panel 30 has a central recess 35 therein. The panel 30 also has a pair of retaining elements 36 affixed to the lower surface thereof and projecting downwardly therefrom.

The panel 30 serves as a means for releasably retaining the display board 22 in the upright operative position. In this regard, it will be seen that, when the display board 22 is in the operative position, the panel 30 is horizontally disposed so that the retaining elements 36 engage the inner surface of the front wall or the front wall of the uppermost tray. It will further be noted that, when the display board 22 is in the upright position, it is inclined upwardly and slightly rearwardly so that the front surface of the board is positioned for optimum viewing by the user.

Figure 3:
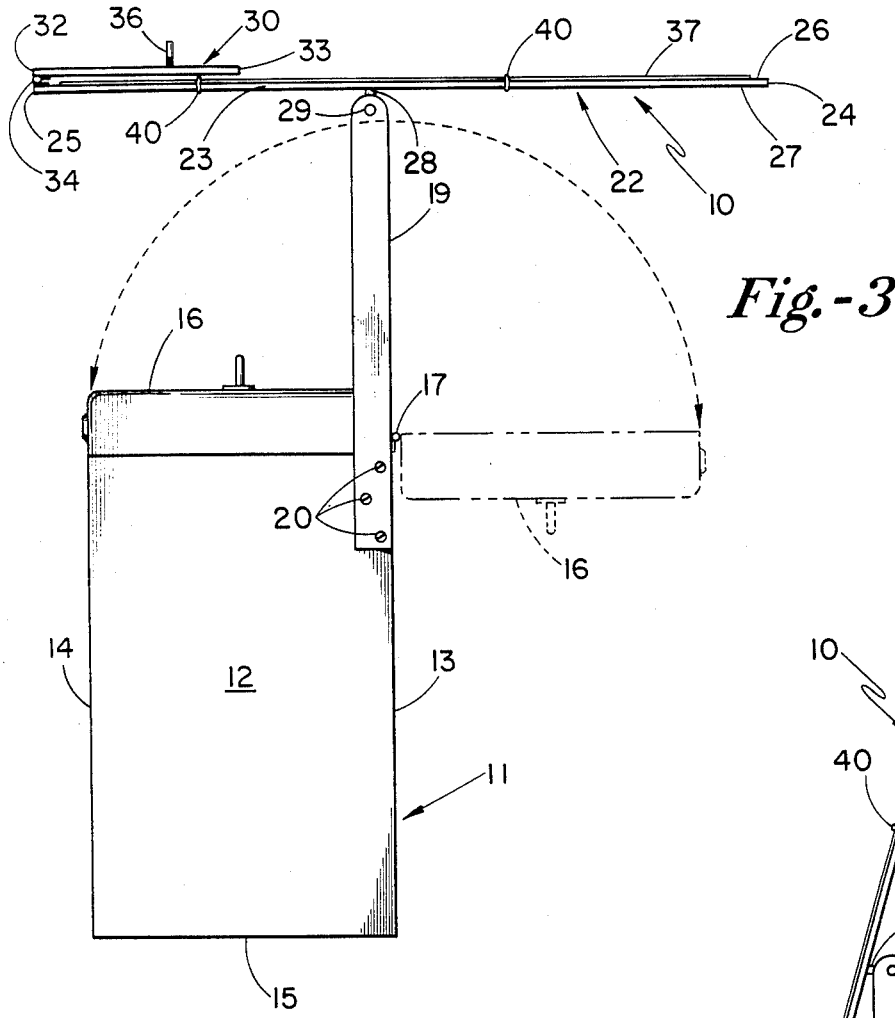
FIG. 3 is a side elevational view illustrating the position of the display board in the collapsed inoperative position.
Figure 4:
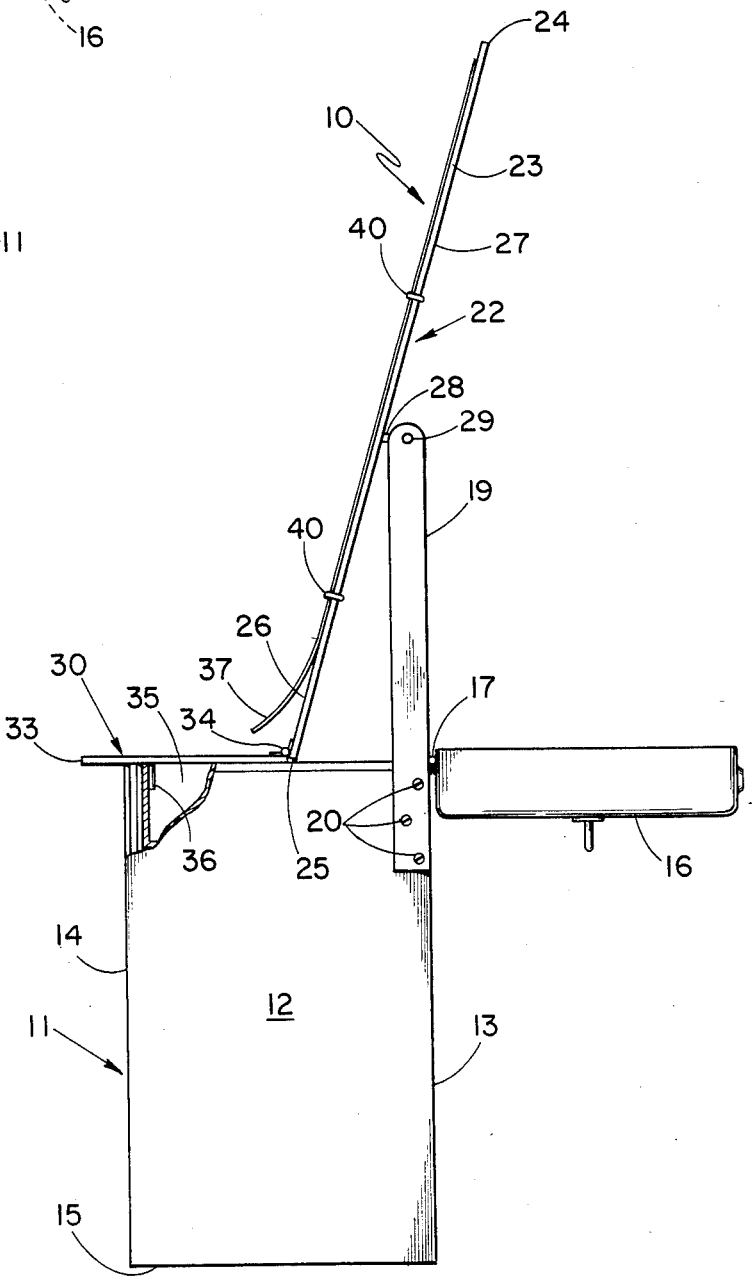
FIG. 4 is a side elevational view thereof with certain parts broken away for clarity.

Referring now to FIG. 3, it will be seen that, when the display board is in the inoperative collapsed position, the panel 30 is folded to horizontally rest upon the display board, and the board is in a generally horizontally disposed position above the tool box. When the display board is in the inoperative collapsed position, the cover 16 of the tool box may be readily opened or closed, as desired. This permits the tool box to be opened and closed, locked, and unlocked by the user, even though the display board attachment remains attached to the tool box.

Blueprints, shop drawings, and the like are ordinarily positioned on the front surface 26 of the display board when the latter is in the operative position, and means is provided for preventing smudging of the drawing with grease or oil. This means includes a transparent cover 37 formed of a flexible transparent plastic material and corresponding in size and configuration to the display board 22. An elongate attachment tape 38 having opposed adhesive surfaces is applied to the front surface 26 of the display board adjacent the upper edge 24 thereof and the transparent cover 37 is secured to the tape adjacent its upper transverse edge. With this arrangement, the transparent cover may be readily lifted so that a shop drawing or print may be positioned upon the front surface 26 of the display board.

Reference cords 39 are provided and each is formed of an elastic material to permit limited stretching of the cord. Each reference cord 39 has a U-shaped element 40 secured to opposite ends thereof and the U-shaped elements are adapted to be positioned around the side edges of the display board and the side edges of the transparent cover 37. One or more of the reference cords are used, and each cord may be moved upwardly or downwardly along the display board 22. The reference cords serve as a reference line so that a user may direct his attention to that portion of a relatively large drawing. This enables the user to view a particular part or a particular dimension without searching.

In use, the display board attachment 10 will be attached to a conventional tool box 11 with a post secured to the side walls 12 of the tool box. The display board will be pivoted to the inoperative position when it is desirable to open or close the tool box. The tool box may be of the type which has a pivotal or removable front wall 14 which may be removed from locked relation with the cover. The user will pivot the display board to the operative upright condition and will place a suitable drawing or print on the front surface thereof. The transparent cover will protect the drawing against damage by oil or grease and the drawing will be displayed to a user at optimum position for viewing. The reference cords 39 will be positioned at a selected location of the drawing, and the reference cords also serve to retain the transparent cover and drawing in clamped relation with respect to the display board. In some instances, the user may want to modify a component illustrated on the drawing or to change a dimension, and this can be done by writing with a suitable grease pencil or other marker upon the transparent cover. When the job is completed, the user may simply wipe the marking from the transparent cover and the drawings may thereafter be removed.

The display board 22 may have a decimal equivalency chart D, a drill index chart I, or a metric conversion chart C attached to the front surface thereof for ready reference by a machinist. These charts are typically used by machinists and other skilled artisans in machine shops.

From the foregoing description, it will be seen that I have provided a novel display board attachment which may be readily mounted on a tool box for displaying a blueprint or shop drawing for optimum viewing by a user.

It will also be seen from the preceding paragraphs that I have provided a novel display board attachment, which is not only of simple and inexpensive construction, but one which functions in a more efficient manner than any heretofore known comparable device.

What is claimed is:

1. A display board attachment for a conventional tool box having front and rear walls, opposed side walls, a bottom wall, and a cover, the latter being swingable between open and closed positions, comprising:

a pair of elongate vertically disposed posts, means for attaching the lower end portion of each post to the sides of the tool box so that the posts project vertically upwardly therefrom, a generally rectangular-shaped display board having upper and lower edges and side edges, said display board having flat front and rear surfaces, means pivotally connecting said display board to the upper end portions of the posts to permit pivotal movement of the board between a collapsed horizontal position and an upwardly inclined operative position, said display board presenting said front surface forwardly when in the inclined operative position, and being spaced above the tool box and presenting said front surface upwardly when in the collapsed horizontal position, a retaining panel having substantially flat upper and lower surfaces and being pivotally connected to the display board adjacent the lower end of the latter, said panel having a pair of laterally spaced apart retaining elements on its lower surface and depending therefrom, and engageable with the tool box when the tool box cover is in the open position to retain the display board in its operative position and retaining the panel in a horizontal position forwardly of said display board, said panel being foldable against and upon the front surface of the display board when the latter is in the collapsed horizontal position to thereby permit the cover to swing below said display board between open and closed positions, and a generally rectangular-shaped transparent cover member having an upper edge secured to the upper edge portion of said display board whereby said cover may be raised to permit a drawing to be supported between the display board and transparent cover.

2. The display board attachment as defined in claim 1 and an elongate reference cord slidably mounted on said board exteriorly of said transparent cover and engaging the side edges of said board.

* * * * *